US008073354B2

(12) United States Patent
Yamada

(10) Patent No.: US 8,073,354 B2
(45) Date of Patent: Dec. 6, 2011

(54) IMAGE FORMING APPARATUS THAT CONTROLS THE NUMBER OF PRINTED SHEETS

(75) Inventor: Akihiro Yamada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 236 days.

(21) Appl. No.: 11/933,643

(22) Filed: Nov. 1, 2007

(65) Prior Publication Data

US 2008/0101815 A1 May 1, 2008

(30) Foreign Application Priority Data

Nov. 1, 2006 (JP) ..... 2006-297974

(51) Int. Cl.
*G03G 21/02* (2006.01)

(52) U.S. Cl. ..... 399/79; 399/80; 399/81

(58) Field of Classification Search ..... 399/75, 399/79, 80, 81
See application file for complete search history.

(56) References Cited

U.S. PATENT DOCUMENTS

| | | | | |
|---|---|---|---|---|
| 6,088,550 | A | 7/2000 | Asai et al. | |
| 6,714,316 | B1 * | 3/2004 | Nishiyama | 358/1.18 |
| 7,020,408 | B2 * | 3/2006 | Lester et al. | 399/79 |
| 7,075,666 | B1 * | 7/2006 | Aiyama | 358/1.13 |
| 7,158,946 | B2 * | 1/2007 | Sato et al. | 705/26 |
| 2005/0047813 | A1 * | 3/2005 | Hosoi et al. | 399/87 |
| 2007/0162480 | A1 * | 7/2007 | Garg et al. | 707/101 |

FOREIGN PATENT DOCUMENTS

| | | |
|---|---|---|
| JP | 09-146428 | 6/1997 |
| JP | 10-301456 | 11/1998 |
| JP | 2000-081818 | 3/2000 |
| JP | 2001-034446 | 2/2001 |
| JP | 2003-295715 | 10/2003 |
| JP | 2005-062647 | 3/2005 |
| JP | 2005-242254 | 9/2005 |
| JP | 2006-004167 | 1/2006 |
| JP | 2006-010969 | 1/2006 |
| JP | 2006-202063 | 8/2006 |

OTHER PUBLICATIONS

Simmons College printing policy [online]. Simmons College Technology, 2009 [archive.org date of May 9, 2006]. Retrieved from the Internet: < http://my.simmons.edu/printing/>.*
Notification of Reasons for Refusal: Japanese Application No. 2006-297974, mailed Oct. 16, 2008.
Japanese Notification of Reasons for Refusal 2006-297974 Mailed Mar. 5, 2009.

* cited by examiner

*Primary Examiner* — David Gray
*Assistant Examiner* — Barnabas Fekete
(74) *Attorney, Agent, or Firm* — Banner & Witcoff, Ltd.

(57) ABSTRACT

An image forming apparatus is described. The image forming apparatus may be for printing sheets on the basis of a print instruction input therein, including: a limit quantity storage unit storing a predetermined limit quantity; an accounting storage unit storing an accounting for printing one sheet; and a printing authorization unit authorizing execution of printing, when the print instruction is input, after a quantity of a consumer product consumed by printing reaches the limit quantity stored in the limit quantity storage unit, on condition that a user pays a price obtained by multiplying the number of sheets which should have been continuously printed on the basis of the print instruction by the accounting with reference to the accounting storage unit.

8 Claims, 5 Drawing Sheets

FIG. 2

| USER | LIMIT NUMBER | CUMULATIVE NUMBER OF PRINTED SHEETS | UNIT SHEET PRICE 1 (YEN) | UNIT SHEET PRICE 2 (YEN) |
|---|---|---|---|---|
| A | 100 | 80 | 10 | 12 |
| B | 50 | 43 | 8 | 10 |
| C | 70 | 51 | 10 | 12 |

21

FIG. 3

| USER | LIMIT CONSUMPTION RATE | CUMULATIVE PRINT CONSUMPTION RATE | UNIT TONER PRICE 1 (YEN) | UNIT TONER PRICE 2 (YEN) |
|---|---|---|---|---|
| A | 5000 | 8000 | 10 | 12 |
| B | 4000 | 7000 | 8 | 10 |
| C | 3000 | 5000 | 10 | 12 |

23

IMAGE FORMING APPARATUS THAT CONTROLS THE NUMBER OF PRINTED SHEETS

CROSS REFERENCE TO RELATED APPLICATION

This application claims priority to Japanese Patent Application No. 2006-297974, filed on Nov. 1, 2006, the disclosures of which are hereby incorporated into the present application by reference.

TECHNICAL FIELD

The present invention relates to an image forming apparatus having a function for controlling the number of printed sheets.

BACKGROUND

For an office or the like, there is proposed an image forming apparatus having the so-called department control function for the number of copies, for preventing excess copying when a reserved number of copies set for copying exceeds the number of copiable sheets per department.

When the reserved number of copies exceeds the number of copiable sheets controlled by the department control function per department, this image forming apparatus displays a warning about this excess. After making copies by the number of copiable sheets, the image forming apparatus discards excess image data.

Due to this department control function, the image forming apparatus can prevent copying in excess of the number of copiable sheets previously allocated to each department, whereby the expenses can be saved in each department, and the user can be prompted to refrain from unnecessary copying.

If absolutely necessary image data are discarded when the reserved number of copies exceeds the number of copiable sheets, however, the image forming apparatus is not user-friendly. While all image data may conceivably be copied within the number of copiable sheets by using both surfaces of each copying sheet (the so-called DX (duplex) printing) or by copying image data for a plurality of sheets on a single surface of each sheet in a reduced size (the so-called N-in-1 printing), this may not be desirable for the user.

SUMMARY

One aspect of the present invention may provide an image forming apparatus capable of executing printing in excess of the number of printable sheets if necessary while maintaining an effect of a department control function.

The same or different aspect of the present invention may provide an image forming apparatus for printing sheets on the basis of a print instruction input therein, including: a limit quantity storage unit storing a predetermined limit quantity; an accounting storage unit storing an accounting for printing one sheet; and a printing authorization unit authorizing execution of printing, when the print instruction is input, after a quantity of a consumer product consumed by printing reaches the limit quantity stored in the limit quantity storage unit, on condition that a user pays a price obtained by multiplying the number of sheets which should have been continuously printed on the basis of the print instruction by the accounting with reference to the accounting storage unit.

BRIEF DESCRIPTION OF THE DRAWINGS

FIG. 2 illustrates an example of a table stored in an EEPROM.

FIG. 3 illustrates an example of another table stored in the EEPROM.

DETAILED DESCRIPTION

Embodiments of one or more aspects of the present invention are now described with reference to the drawings.

First Embodiment

Figure 1:
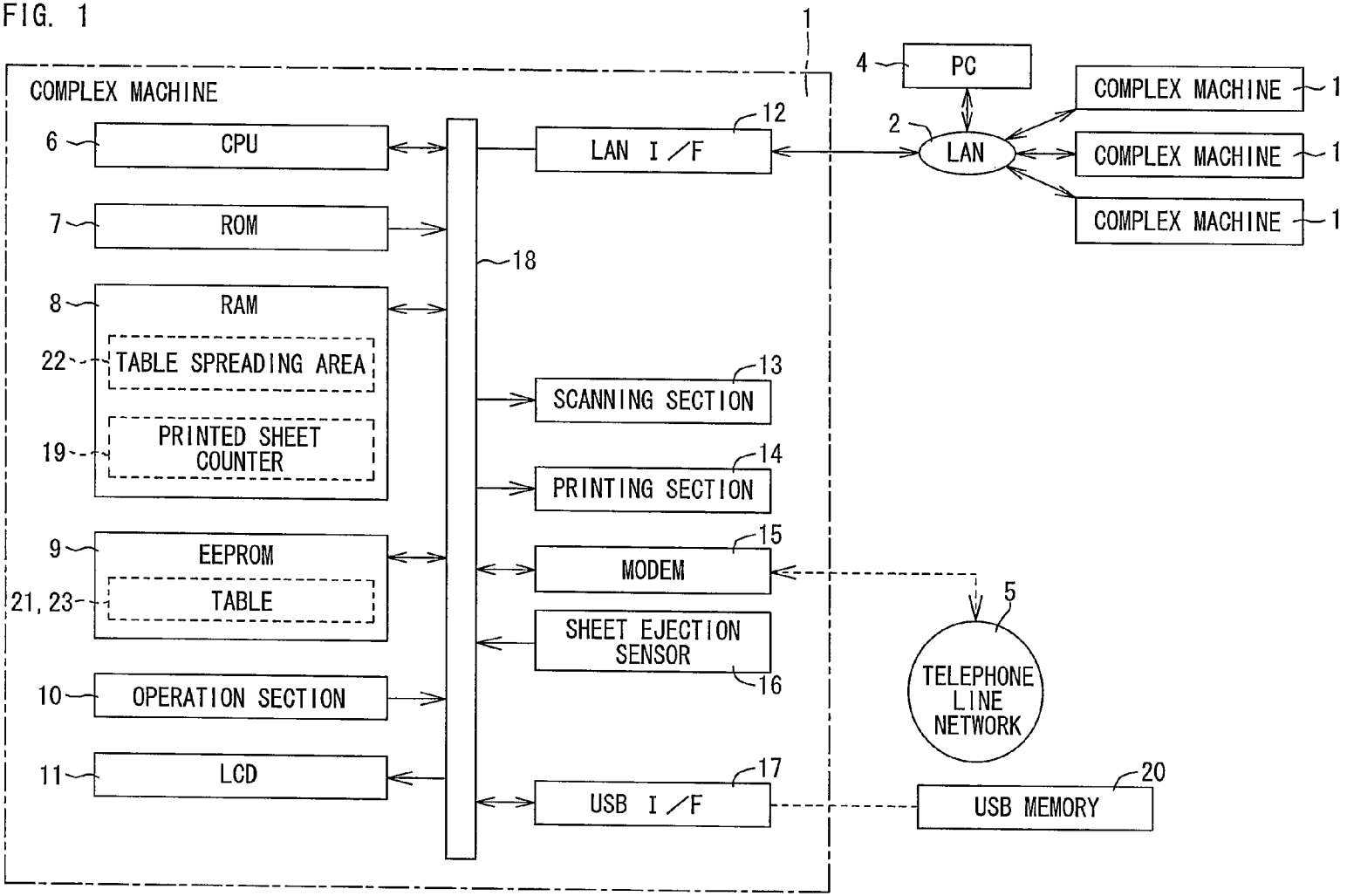
FIG. 1 is a block diagram showing the structure of an image forming system including complex machines as examples of an image forming apparatus of one or more aspects of the present invention.

FIG. 1 is a block diagram showing the structure of an image forming system including complex machines as examples of an image forming apparatus of one or more aspects of the present invention.

This image forming system includes a plurality of complex machines 1 connected to a LAN (local area network) 2 constructed in an office or the like. A personal computer (hereinafter referred to as "PC") 4 for transmitting image data and an image formation (printing) command to each complex machine 1 and making the complex machine 1 execute print processing is connected to the LAN 2.

Each complex machine 1 has a printing function for outputting an image based on the image data received from the PC 4 to each sheet, a copying function for reading a document image and reproducing the document image on the sheet, and a facsimile function for reading the document image and transmitting the data of the read document image to the exterior through a telephone line network 5 and outputting to the sheet an image based on image data transmitted from the exterior through the telephone line network 5.

In order to implement these functions, the complex machine 1 includes a LAN I/F (interface) 12 for connecting the complex machine 1 with the LAN 2, a scanning section 13 optically reading the document image, a printing section 14 outputting the image data to the sheet, a modem 15 for connecting the complex machine 1 with the telephone line network 5, and a sheet ejection sensor 16 outputting a pulse signal (detection signal) in response to ejection of each sheet printed in the printing section 14, as well as a CPU 6, a ROM 7, a RAM 8 and an EEPROM 9 for controlling these elements. The CPU 6 functions as a printing authorization unit.

The LAN I/F 12, the scanning section 13, the printing section 14, the modem 15, the sheet ejection sensor 16, the CPU 6, the ROM 7, the RAM 8 and the EEPROM 9 are connected with one another through a bus line 18, to be capable of transmitting/receiving data to/from one another.

The ROM 7 stores various control programs etc. executed by the CPU 6.

The RAM 8 is used as a work area for temporarily storing data, a program and the like when the CPU 6 executes any of the control programs. For example, a printed sheet counter 19 for counting the number of sheets whose ejection has been detected by the sheet ejection sensor 16 (number of sheets printed in the printing section 14), a table spreading area 22 for spreading data of a table 21 described later and temporarily holding the same and the like are set in this RAM 8.

The EEPROM 9 stores the table 21 described later.

An operation section 10 as an example of a setting unit including operation keys etc. operated by the user and an LCD 11 as an example of a display unit displaying information such as the operating situation of the complex machine 1 are connected to the bus line 18.

The complex machine 1 further includes a USB port (not shown) for connecting a USB memory 20 to the complex machine 1. The complex machine 1 also includes a USB I/F 17 for connecting the USB memory 20 inserted into the USB port and the bus line 18 with each other.

The complex machine 1 has the so-called department control function. The department control function is a function for controlling the number of sheets subjected to image formation (printing) in the complex machine 1 per user (department) in an office or the like and preventing the user from excessive printing when the number of sheets subjected to image formation exceeds a prescribed limit number.

FIG. 2 illustrates an example of the table 21 stored in the EEPROM 9.

As shown in FIG. 2, numbers (limit numbers) of sheets image-formable (printable) in this complex machine 1 are allocated to three users A, B and C respectively in the table 21 as an example of a limit quantity storage unit and an accounting storage unit, in consideration of the fact that the frequency of use of the complex machine 1 varies with the user A, B or C. In other words, the limit numbers for the users A, B and C are set to 100, 50 and 70 respectively.

The table 21 stores numbers (cumulative numbers of printed sheets) of image formation executed by the users A, B and C in association with the users A, B and C respectively. When the user A has already executed printing on 80 sheets in the complex machine 1, for example, the table 21 stores the number 80 as the cumulative number of printed sheets in association with the user A.

The table 21 also shows two types of unit prices to be paid by the users A, B and C per printing. A unit sheet price 1 is a price to be paid by each user for printing within the limit number, and a unit sheet price 2 is a price to be paid for printing in excess of the limit number. The unit sheet price 2 is set higher than the unit sheet price 1. For example, the unit sheet prices 1 and 2 for the user A are set to 10 yen and 12 yen respectively. The unit sheet prices 1 and 2 are individually set for the users A, B and C in proportion to the limit numbers respectively. For example, the unit sheet price 1 for the user A is set to 10 yen, while that for the user B is set to 8 yen.

Figure 4:
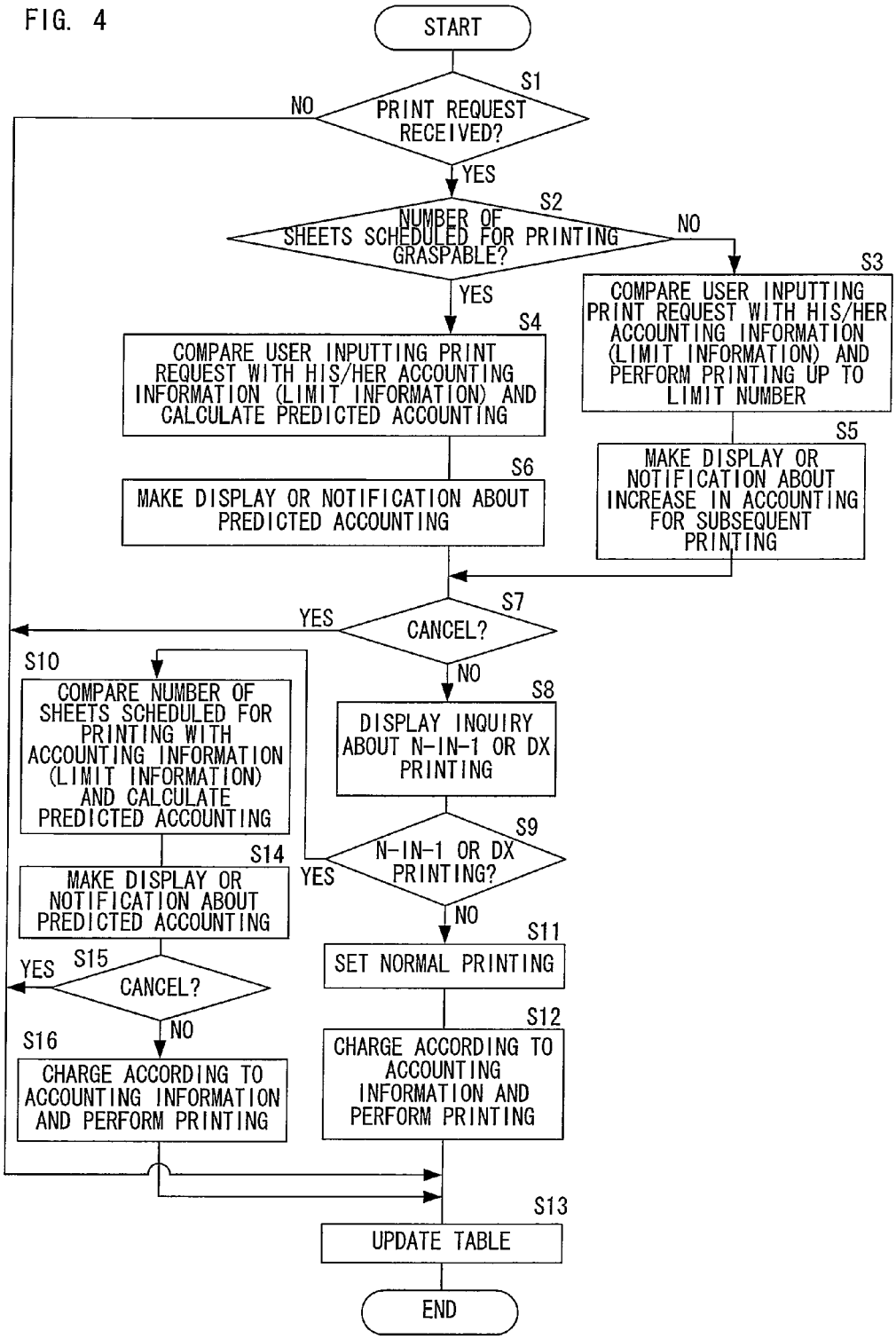
FIG. 4 is a flow chart showing processing related to a department control function with reference to the number of printed sheets.

FIG. 4 is a flow chart showing processing related to the department control function with reference to the number of printed sheets.

When any user operates the operation section 10 and inputs an instruction for image formation (may hereinafter be referred to also as printing) in the printing section 14, for example, the CPU 6 determines that a print request is received (YES at S1). Alternatively, the print request (instruction command for image formation) may be input from the PC 4 or any other complex machine 1 along with the image data through the LAN 2. The processing described below is not performed unless the print request is received (NO at S1).

When the print request is received, the CPU 6 determines whether or not the number of sheets scheduled for printing (number of sheets to be printed in response to the print request) is graspable (S2). More specifically, the CPU 6 checks whether or not the number of sheets scheduled for printing has been input through the operation section 10, and determines that the number of sheets scheduled for printing is ungraspable if the same has not been input (NO at S2). If the number of sheets scheduled for printing has been input, on the other hand, the CPU 6 determines that the number of sheets scheduled for printing is graspable (YES at S2). If the print request is received from the PC 4 or any other complex machine 1, the CPU 6 may grasp the number of sheets scheduled for printing from data on the number of sheets scheduled for printing received along with the print request, or may spread the image data into bitmap data for grasping the number of sheets scheduled for printing from the bitmap data.

If the number of sheets scheduled for printing is ungraspable (NO at S2), the CPU 6 then reads the table 21 stored in the EEPROM 9 and spreads the data of the table 21 in the table spreading area 22. Thereafter the CPU 6 refers to the data of the table spreading area 22, and acquires the limit number, the cumulative number of printed sheets and the unit sheet prices 1 and 2 (see FIG. 2) for the user inputting the print request. If the cumulative number of printed sheets is less than the limit number, the CPU 6 makes the printing section 14 execute image formation (printing) on the basis of the image data. The sheet ejection sensor 16 outputs a pulse signal every time the printing section 14 performs printing and ejects a printed sheet. The CPU 6 increments (+1) the count of the printed sheet counter 19 provided in the RAM 8 in response to the pulse signal output from the sheet ejection sensor 16. The count of the printed sheet counter 19 has been reset to zero before this processing has been started. The printing section 14 performs the printing until the sum of the cumulative number of printed sheets and the count of the printed sheet counter 19 reaches the limit number (S3). The unit sheet price 1 is charged per printed sheet in the printing up to the limit number.

When the printing is performed up to the limit number, the CPU 6 makes the LCD 11 display information indicating that the unit sheet price 2 higher than the unit sheet price 1 is applied to subsequent printing of the user and the accounting (price for the subsequent printing) is thereby increased (S5). In place of the display on the LCD 11, the CPU 6 may notify the user of the increase of the accounting by a sound from a speaker (not shown).

If the number of sheets scheduled for printing is graspable (YES at S2), on the other hand, the CPU 6 reads the table 21 stored in the EEPROM 9 and spreads the data of the table 21 in the table spreading area 22. Thereafter the CPU 6 refers to the data of the table spreading area 22, and calculates the price (predicted accounting) required for performing printing by the number of sheets scheduled for printing (S4). If the number of sheets scheduled for printing is in excess of the limit number, the CPU 6 calculates the predicted accounting by summing up a within-limit price obtained by multiplying the number of sheets not exceeding the limit number by the unit sheet price 1 and an out-of-limit price obtained by multiplying the number of sheets exceeding the limit number by the unit sheet price 2.

The CPU 6 displays the predicted accounting calculated at the step S4 on the LCD 11, or notifies the user of the predicted accounting by a sound from the speaker (S6)

After the display or the notification at the step S5 or S6, the CPU 6 checks whether or not the user operates the operation section 10 and instructs cancellation of printing (S7).

If the user instructs cancellation, the CPU 6 terminates this series processing.

If the user instructs no cancellation, on the other hand, the CPU 6 makes the LCD 11 display an inquiry about whether or not to perform DX printing or N-in-1 printing in place of normal printing (printing image data corresponding to a single surface on the single surface of each sheet) (S8).

When the user operates the operation section 10 and selects DX printing or N-in-1 printing of the image data (YES at S9), the CPU 6 calculates the price (predicted accounting) in DX printing or N-in-1 printing (S10). More specifically, if the user selects DX printing, the CPU 6 sets a value (rounded off if not divisible) obtained by dividing the number of sheets scheduled for printing by 2 as the number of sheets scheduled for DX printing. If the number of sheets scheduled for DX printing exceeds the limit number, the CPU 6 calculates the predicted accounting by summing up the within-limit price obtained by multiplying the number of sheets not exceeding the limit number by the unit sheet price 1 and the out-of-limit price obtained by multiplying the number of sheets exceeding the limit number by the unit sheet price 2. If the user selects N-in-1 printing for printing image data for four sheets on the single surface of each sheet in a reduced manner, for example, the CPU 6 sets a value (rounded off if not divisible) obtained by dividing the number of sheets scheduled for printing by 4 as the number of sheets scheduled for N-in-1 printing. Then, the CPU 6 calculates the predicted accounting for the number of sheets scheduled for N-in-1 printing, similarly to the case for the number of sheets scheduled for DX printing.

The CPU 6 makes the LCD 11 display the predicted accounting calculated at the step S10, or notifies the user of the predicted accounting by a sound from the speaker (S14).

After the display or the notification at the step S14, the CPU 6 checks whether or not the user operates the operation section 10 and instructs cancellation of printing (S15).

If the user instructs cancellation (YES at S15), the CPU 6 terminates this series processing.

If the user instructs no cancellation (NO at S15), on the other hand, the CPU 6 charges the aforementioned sum of the within-limit-price and the out-of-limit price in DX printing or N-in-1 printing as the user's accounting, and makes the printing section 14 execute DX printing or N-in-1 printing on condition that the user pays the sum (S16).

If the user operates the operation section 10 and selects neither DX printing nor N-in-1 printing for the image data (NO at S9), on the other hand, the CPU 6 sets normal printing (S11).

Thereafter the CPU 6 charges the aforementioned sum of the within-limit-price and the out-of-limit price to the user with reference to accounting information and limit information of the user, and makes the printing section 14 execute normal printing on condition that the user pays the sum (S12).

When printing is completed at the step S12 or S16, the CPU 6 adds the count of the printed sheet counter 19 to the cumulative number of printed sheets held in the table spreading area 22, and holds the sum in the table spreading area 22 as a new cumulative number of printed sheets. Then, the CPU 6 rewrites the table 21 stored in the EEPROM 9 on the basis of the updated data held in the table spreading area 22 (S13), and terminates this series processing.

If the user performs printing in excess of the limit number and the limit consumption rate by prescribed quantities, the CPU 6 may charge a higher price by raising the aforementioned unit sheet price 2 and the aforementioned unit toner price 2 stepwise.

In this complex machine 1, the table 21 stores the predetermined limit quantity (limit number) as well as the accounting (unit sheet price) for printing a sheet. After the consumption (number of sheets) of the sheets consumed by printing based on the print instruction from the user reaches the limit quantity, the complex machine 1 authorizes execution of printing on condition that the user pays the price obtained by multiplying the number of sheets to be continuously printed on the basis of the print instruction by the accounting.

In other words, even if the number of consumer products consumed by printing based on the print instruction from the user reaches the limit quantity, the user can continuously print the excess in this complex machine 1 by paying the price corresponding to the excess.

Thus, when the consumption of the consumer products consumed by printing based on the print instruction from the user reaches the limit quantity, image data corresponding to the excess can be prevented from being discarded without printing.

However, the excess is printed not free of charge but on condition that the user pays the aforementioned price. Therefore, the user can be prompted to refrain from unnecessary printing.

Consequently, excess printing can be executed in the complex machine 1 if necessary, while maintaining the effect of the department control function.

Further, this complex machine 1 displays the price on the LCD 11 when the number of sheets scheduled for printing is graspable, whereby the user can recognize the price necessary for printing the excess. In addition, the user can select whether or not to print the excess by paying the price after confirming the price. Thus, the user can be further prompted to refrain from unnecessary printing.

The table 21 stores the accounting per user, whereby the complex machine 1 can control the number of printed sheets suitable for each user although the frequency of use of the complex machine 1 varies with the user.

Further, the user can set whether or not to form images for a plurality of sheets on each sheet (DX printing or N-in-1 printing) by operating the operation section 10. If authorizing execution of DX printing or N-in-1 printing, therefore, the user can complete printing without paying the price or reduce the number of sheets for the excess, thereby reducing the consumption of the consumer products.

Second Embodiment

FIG. 3 illustrates an example of another table 23 stored in the EEPROM 9.

According to this embodiment, the EEPROM 9 stores the table 23 shown in FIG. 3, in place of the aforementioned table 21.

In the table 23 as an example of the limit quantity storage unit and an accounting storage unit, consumption rates (limit consumption rates) of toner consumable in this complex machine 1 are allocated to the three users A, B and C in consideration of the fact that the frequency of use of the complex machine 1 varies with the user A, B or C. The term "toner consumption rate" denotes the ratio of the quantity of toner consumed by averagely printing a sheet to the quantity of toner consumed by printing the sheet with no space, and a reference toner consumption rate is generally set to 50%, for example. As shown in FIG. 3, the limit consumption rates for the users A, B and C are set to 5000%, 4000% and 3000% respectively.

The table 23 stores consumption rates (cumulative print consumption rates) of toner consumed by the users A, B and C by printing in association with the users A, B and C respectively. When the user A has already executed printing by 8000% in the complex machine 1, for example, the table 23 stores 8000% as the cumulative print consumption rate in association with the user A.

The table 23 also shows two types of unit prices to be paid by the users A, B and C per printing (on the reference toner consumption rate (50%)). A unit toner price 1 is a price to be paid by each user for printing within the limit consumption rate, and a unit toner price 2 is a price to be paid for printing in excess of the limit consumption rate. The unit toner price 2 is set higher than the unit toner price 1. For example, the unit toner prices 1 and 2 for the user A are set to 10 yen and 12 yen respectively. The unit toner prices 1 and 2 are individually set for the users A, B and C in proportion to the limit numbers respectively. For example, the unit toner price 1 for the user A is set to 10 yen, while that for the user B is set to 8 yen.

Figure 5:
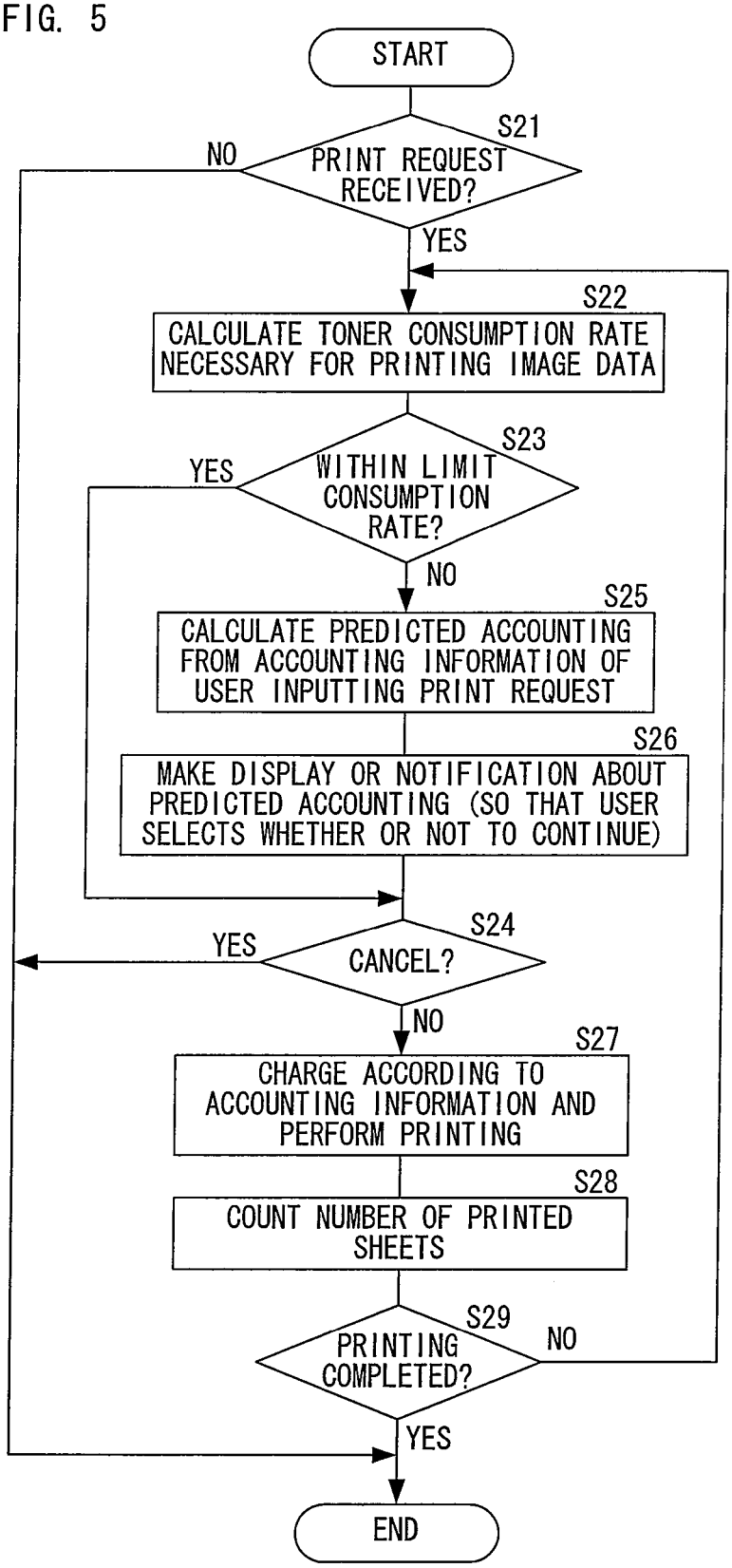
FIG. 5 is a flow chart showing processing related to a department control function with reference to a toner consumption rate.

FIG. 5 is a flow chart showing processing related to the department control function with reference to the toner consumption rate.

When any user operates the operation section 10 and inputs an instruction for image formation (may hereinafter be referred to also as printing) in the printing section 14, for example, the CPU 6 determines that a print request is received (YES at S21). Alternatively, the print request (instruction command for image formation) may be input from the PC 4 or any other complex machine 1 along with image data through the LAN 2. The processing described below is not performed unless the print request is received (NO at S21).

When the print request is received, the CPU 6 calculates the number of dots of an image to be formed on each sheet on the basis of the image data and calculates the toner consumption rate (necessary toner consumption rate) necessary for printing the image data on the basis of the number of dots (S22).

Then, the CPU 6 reads the table 23 stored in the EEPROM 9, and spreads the data of the table 23 in the table spreading area 22. Thereafter the CPU 6 refers to the data of the table spreading area 22, compares a value (total consumption rate) obtained by adding the necessary toner consumption rate obtained at the step S22 to the cumulative consumption rate, with the limit consumption rate, and determines whether or not the total consumption rate is within the limit consumption rate (S23).

If the total consumption rate is in excess of the limit consumption rate (NO at S23), the CPU 6 refers to the data of the table spreading area 22, and calculates the price (predicted accounting) corresponding to the necessary toner consumption rate (S25) If the sum of the toner consumption rates necessary for printing first and second sheets and the cumulative consumption rate is still within the limit consumption rate but the limit consumption rate is exceeded when a toner consumption rate necessary for printing a third sheet is further added to the sum, for example, the CPU 6 calculates the predicted accounting by summing up a within-limit-price obtained by multiplying the unit toner price 1 by 2 (for two sheets) and an out-of-limit price obtained by multiplying the number of the third and subsequent sheets by the unit toner price 2.

Then, the CPU 6 makes the LCD 11 display the predicted accounting calculated at the step S25 (S26). In place of the display on the LCD 11, the CPU 6 may notify the user of the predicted accounting by a sound from the speaker (not shown). If the total consumption rate is in excess of the limit consumption rate by printing up to the necessary toner consumption rate, the CPU 6 makes a display or a notification for prompting the user to select whether or not to continue printing.

After the display or the notification at the step S26, the CPU 6 checks whether or not the user operates the operation section 10 and instructs cancellation of printing (S24). If the total consumption rate is within the limit consumption rate (YES at S23), the CPU 6 immediately checks whether or not the user instructs cancellation of printing (S24).

If the user instructs cancellation (YES at S24), the CPU 6 terminates this series processing.

If the user instructs no cancellation, the CPU 6 charges the aforementioned sum of the within-limit-price and the out-of-limit price to the user with reference to the aforementioned accounting information and limit information of the user, and makes the printing section 14 execute printing on condition that the user pays the sum (S27). In this printing, normal printing, DX printing or N-in-1 printing may be selectively executed.

In the printing at the step S27, the sheet ejection sensor 16 outputs a detection result (pulse data) to the printed sheet counter 19 of the RAM 8 every time a printed sheet is ejected, so that the CPU 6 counts the number of printed sheets and stores information on the number of printed sheets in the printed sheet counter 19 (S28).

Unless the printing is completed (NO at S29), the CPU 6 repeats the processing through the steps S22 to S29.

When the printing is completed (YES at S29), the CPU 6 adds a value obtained by multiplying the number of printed sheets counted in the printed sheet counter 19 by the reference toner consumption rate (50%) to the cumulative printing consumption rate held in the table spreading area 22, and holds the resulting sum in the table spreading area 22 as a new cumulative printing consumption rate. Then, the CPU 6 rewrites the table 23 stored in the EEPROM 9 on the basis of the updated data held in the table spreading area 22, and terminates this series processing.

Also according to this embodiment, effects similar to those of the aforementioned embodiment (processing shown in FIG. 4) can be attained.

Third Embodiment

Figure 6:
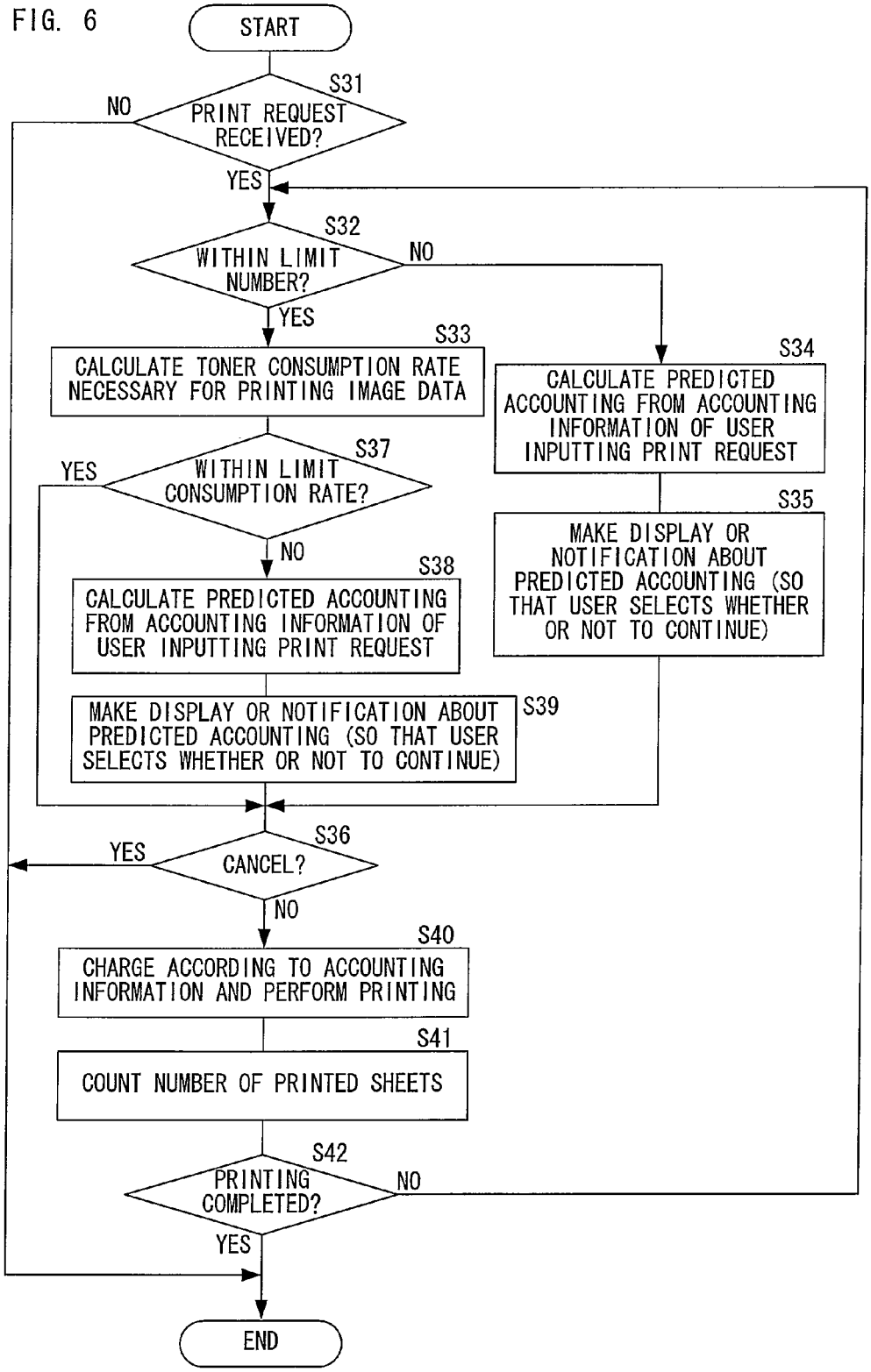
FIG. 6 is a flow chart showing processing related to a department control function with reference to both of the number of printed sheets and a toner consumption rate.

FIG. 6 is a flow chart showing processing related to a department control function with reference to both of the number of printed sheets and a toner consumption rate.

According to this embodiment, the EEPROM 9 stores both of the tables 21 and 23 as shown in FIG. 1 under the condition that both of sheets and toner are consumer products, for putting limitations when consumptions of these consumer products exceed limit consumptions.

Referring to FIG. 6, when any user operates the operation section 10 and inputs an instruction for image formation (may hereinafter be referred to also as printing) in the printing section 14, the CPU 6 determines that a print request is received (YES at S31). Alternatively, the print request (instruction for image formation) may be input from the PC 4 or any other complex machine 1 along with image data through the LAN 2. The processing described below is not performed unless the print request is received (NO at S31).

When the print request is received, the CPU 6 calculates the number of sheets scheduled for printing from the image data. Then, the CPU 6 reads the table 21 stored in the EEPROM 9, and spreads the data of the table 21 in the table spreading area 22. Thereafter the CPU 6 refers to the data of the table spreading area 22, and acquires the limit number, the cumulative number of printed sheets and the unit sheet prices 1 and 2 (see FIG. 2) for the user inputting the print request.

If the cumulative number of printed sheets is less than the limit number (YES at S32), the CPU 6 calculates the number of dots of an image to be formed on each sheet on the basis of the image data and calculates the toner consumption rate (necessary toner consumption rate) necessary for printing the image data on the basis of the number of dots (S33).

Then, the CPU 6 reads the table 23 stored in the EEPROM 9, and spreads the data of the table 23 in the table spreading area 22. Thereafter the CPU 6 refers to the data of the table spreading area 22, compares a value (total consumption rate) obtained by adding the necessary toner consumption rate obtained at the step S33 to the cumulative consumption rate, with the limit consumption rate, and determines whether or not the total consumption rate is within the limit consumption rate (S37).

If the total consumption rate is in excess of the limit consumption rate (NO at S37), the CPU 6 refers to the data of the table spreading area 22, and calculates the price (predicted accounting) corresponding to the necessary toner consumption rate (S38). Since this calculation is similar to that at the step S25 shown in FIG. 5, detailed description thereof is omitted.

The CPU 6 makes the LCD 11 display the predicted accounting calculated at the step S38 (S39). In place of the display on the LCD 11, the CPU 6 may notify the user of the predicted accounting by a sound from the speaker (not shown). If the total consumption rate is in excess of the limit consumption rate by printing up to the necessary toner consumption rate, the CPU 6 makes a display or a notification for prompting the user to select whether or not to continue printing.

If determining that the cumulative number of printed sheets is in excess of the limit number at the step S32, on the other hand, the CPU 6 refers to the data of the table 21 spread in the table spreading area 22, and calculates the price (predicted accounting) corresponding to the number of sheets scheduled for printing (S34). Since this calculation is similar to that at the step S4 shown in FIG. 4, detailed description thereof is omitted.

The CPU 6 makes the LCD 11 display the predicted accounting calculated at a step S34 (S35). In place of the display on the LCD 11, the CPU 6 may notify the user of the predicted accounting by a sound from the speaker (not shown). If the total consumption rate is in excess of the limit consumption rate by printing up to the necessary toner consumption rate, the CPU 6 makes a display or a notification for prompting the user to select whether or not to continue printing.

After the display or the notification at the step S35 or the step S39, the CPU 6 checks whether or not the user operates the operation section 10 and instructs cancellation of printing (S36).

If the user instructs cancellation, the CPU 6 terminates this series processing.

If the user instructs no cancellation, on the other hand, the CPU 6 makes the printing section 14 execute printing on condition that the user pays the price (S40). The user must pay the price (accounting) corresponding to the number of sheets scheduled for printing if the CPU 6 determines that the cumulative number of printed sheets is in excess of the limit number at the step S32, or must pay the price corresponding to the necessary toner consumption rate if the cumulative number of printed sheets is within the limit number.

In the printing at the step S40, the sheet ejection sensor 16 outputs a detection result (pulse data) to the printed sheet counter 19 of the RAM 8 every time a printed sheet is ejected, so that the CPU 6 counts the number of printed sheets and stores information on the number of printed sheets in the printed sheet counter 19 (S41).

Unless the printing is completed (NO at S42), the CPU 6 repeats the processing through the steps S32 to S42.

When the printing is completed (YES at S42), the CPU 6 adds the count of the printed sheet counter 19 to the cumulative number of printed sheets held in the table spreading area 22 and holds the resulting sum in the table spreading area 22 as a new cumulative number of printed sheets. Then, the CPU 6 rewrites the table 21 stored in the EEPROM 9 on the basis of the updated data held in the table spreading area 22. Further, the CPU 6 adds a value obtained by multiplying the number of printed sheets counted in the printed sheet counter 19 by the reference toner consumption rate (50%) to the cumulative print consumption rate held in the table spreading area 22, and holds the resulting sum in the table spreading area 22 as a new cumulative print consumption rate. Then, the CPU 6 rewrites the table 21 stored in the EEPROM 9 on the basis of the updated data held in the table spreading area 22, and terminates this series processing.

Also according to this embodiment, effects similar to those of the aforementioned embodiments (processing shown in FIG. 4 and that shown in FIG. 5) can be attained.

For example, the CPU 6 rewrites the value obtained by adding the count of the printed sheet counter 19 to the cumulative number of printed sheets as a new cumulative number of printed sheets in the table 21 without rewriting the limit number at each of the aforementioned steps S13 and S42, whereby a value obtained by subtracting the cumulative number of printed sheets from the limit number corresponds to the number of image-formable (printable) sheets for next printing. Alternatively, the CPU 6 may rewrite a value obtained by subtracting the count of the printed sheet counter 19 from the limit number, as a new limit number. In other words, if the limit number is decremented every count of the printed sheet counter 19 during printing, the updated limit number corresponds to the number of image-formable sheets. In this case, the table 21 may not store the cumulative number of printed sheets. Similarly to this rewriting in the table 21, the CPU 6 may rewrite the limit consumption rate in place of the cumulative print consumption rate in the table 23 at each of the aforementioned steps S29 and S42.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus for printing sheets on the basis of a print instruction input therein, comprising:

a limit quantity storage unit storing a predetermined limit quantity;

an accounting storage unit storing a first unit price for printing one sheet to be used until the predetermined limit quantity is reached, and a second unit price for printing one sheet after the predetermined limit quantity is reached, the first unit price being greater than zero and the second unit price being greater than the first unit price; and a printing authorization unit calculating a number of sheets to be printed and an amount of toner to be used to complete the print instruction, determining whether or not a quantity of a consumer product consumed by printing reached the limit quantity stored in the limit quantity storage unit based on the calculated number of sheets to be printed and the amount of toner to be used, and authorizing execution of printing, when the print instruction is input, on condition that a user pays a price for printing sheets beyond the predetermined limit quantity obtained by multiplying the number of sheets to be printed beyond the predetermined limit quantity by the second unit price when it is determined by the printing authorization unit that the quantity of the consumer product consumed by printing reached the limit quantity, and presenting a user with an option of printing either on both sides of a sheet or printing image data for multiple sheets on a single sheet when the limit quantity is reached;

wherein, when the print instruction is entered into the image forming apparatus, the printing authorization unit determines whether or not the number of sheets scheduled for printing is graspable, and then if the printing authorization unit determines that the number of sheets scheduled for printing is graspable, the printing authorization unit notifies the user of a total price to be paid for printing the number of sheets to be printed before any printing occurs; and if the printing authorization unit determines that the number of sheets scheduled for printing is not graspable, sheets are printed until the limit quantity is reached, at which point the user is then notified that all subsequent printing will be performed at the second unit price.

2. The image forming apparatus according to claim 1, comprising a display unit displaying the price in advance of authorization by the printing authorization unit.

3. The image forming apparatus according to claim 1, wherein the accounting storage unit stores the accounting per user.

4. The image forming apparatus according to claim 1, comprising a setting unit for setting whether or not to form images for a plurality of sheets on a sheet, in advance of authorization by the printing authorization unit.

5. An image forming apparatus for printing sheets on the basis of a print instruction input therein, comprising:

a limit quantity storage means storing a predetermined limit quantity;

an accounting storage means storing a first unit price for printing one sheet to be used until the predetermined limit quantity is reached, and a second unit price for printing one sheet after the predetermined limit quantity is reached, the first unit price being greater than zero and the second unit price being greater than the first unit price; and a printing authorization means calculating a number of sheets to be printed and an amount of toner to be used to complete the print instruction, determining whether or not a quantity of a consumer product consumed by printing reached the limit quantity stored in the limit quantity storage means based on the calculated number of sheets to be printed and the amount of toner to be used, and authorizing execution of printing, when the print instruction is input, on condition that a user pays a price for printing sheets beyond the predetermined limit quantity obtained by multiplying the number of sheets to be printed beyond the predetermined limit quantity by the second unit price when it is determined by the printing authorization means that the quantity of the consumer product consumed by printing reached the limit quantity, and presenting a user with an option of printing either on both sides of a sheet or printing image data for multiple sheets on a single sheet when the limit quantity is reached;

wherein, when the print instruction is entered into the image forming apparatus, the printing authorization means determines whether or not the number of sheets scheduled for printing is graspable, and then if the printing authorization means determines that the number of sheets scheduled for printing is graspable, the printing authorization means notifies the user of a total price to be paid for printing the number of sheets to be printed before any printing occurs; and if the printing authorization means determines that the number of sheets scheduled for printing is not graspable, sheets are printed until the limit quantity is reached, at which point the user is then notified that all subsequent printing will be performed at the second unit price.

6. The image forming apparatus according to claim 5, further comprising a display means displaying the first unit price and the second unit price in advance of authorization by the printing authorization means.

7. The image forming apparatus according to claim 5, wherein the accounting storage means stores the accounting per user.

8. The image forming apparatus according to claim 5, comprising a setting means for setting whether or not to form images for a plurality of sheets on a sheet, in advance of authorization by the printing authorization means.

* * * * *